US005358053A

United States Patent [19]

Akkerman

[11] Patent Number: 5,358,053

[45] Date of Patent: Oct. 25, 1994

[54] SUBSURFACE SAFETY VALVE

[75] Inventor: Neil H. Akkerman, Houston, Tex.

[73] Assignee: AVA International Corporation, Houston, Tex.

[21] Appl. No.: 32,767

[22] Filed: Mar. 16, 1993

Related U.S. Application Data

[63] Continuation of Ser. No. 678,661, Apr. 1, 1991, abandoned.

[51] Int. Cl.[5] ..... E21B 34/10

[52] U.S. Cl. ..... 166/321; 166/332

[58] Field of Search ..... 166/321, 319, 332; 251/62, 58

[56] References Cited

U.S. PATENT DOCUMENTS

| | | | |
|---|---|---|---|
| 3,750,751 | 8/1973 | Mott | 166/321 |
| 3,799,258 | 3/1974 | Tausch | 166/72 |
| 4,161,219 | 7/1979 | Pringle | 166/324 |
| 4,550,780 | 11/1985 | Mott | 166/321 X |
| 4,699,355 | 10/1987 | Tomlin et al. | 251/62 |
| 4,890,674 | 1/1990 | Le | 166/321 X |
| 5,004,007 | 4/1991 | Johnson et al. | 166/321 X |

*Primary Examiner*—Terry Lee Melius
*Attorney, Agent, or Firm*—Vaden, Eickenroht, Thompson, Boulware & Feather

[57] ABSTRACT

There is disclosed a subsurface tubing safety valve having a normally closed flapper which is adapted to be moved to open position by a flow tube reciprocable within the body of the valve. The flow tube is urged to flapper opening position by hydraulic fluid from a remote source and is urged to a position permitting the flapper to close by a curved beam type spring.

4 Claims, 2 Drawing Sheets

FIG. 2
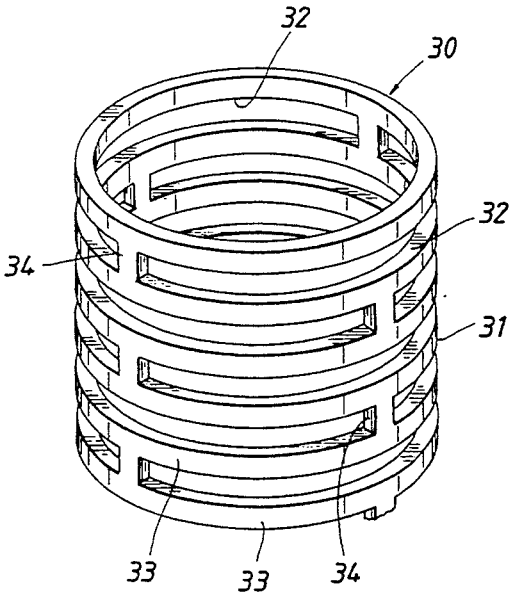
FIG. 4
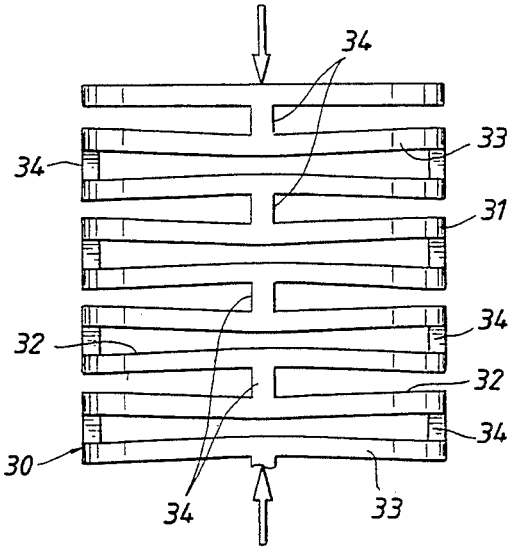
FIG. 3
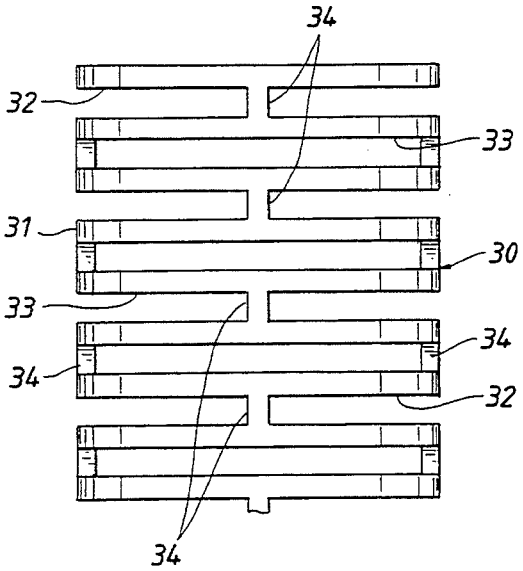
FIG. 6
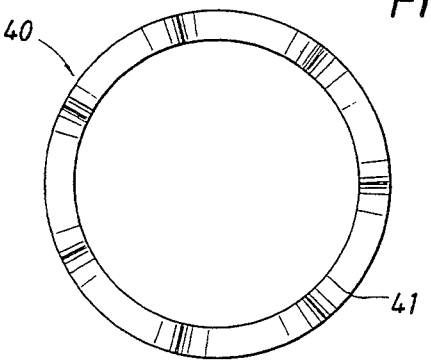
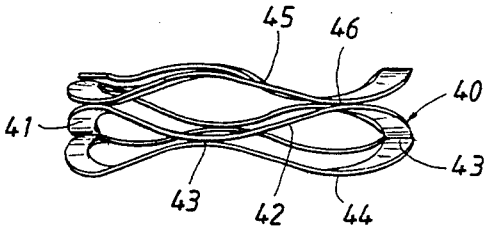
FIG. 5

SUBSURFACE SAFETY VALVE

This application is a continuation division, of application No. 07/678,661, filed Apr. 1, 1991, now abandoned.

This invention relates generally to subsurface safety valves for controlling flow within a well string suspended within a well bore. More particularly, it relates to improvement in valves of this type in which a closure member is pivotally mounted within the bore of a tubular body disposable within the well string for movement between positions opening and closing the bore, and wherein the closure member is yieldably urged by spring means to its closed position but is adpapted to be moved to open position in response to the supply of hydraulic fluid pressure from a remote source at the surface to piston means associated with the closure member. Ordinarily, the valve is adapted to close automatically in response to the exhaust of such fluid in the event of failure of a monitored condition in or about the well.

Many such valves are tubing safety valves wherein the body of the valve is disposed within a well tubing string for controlling flow therethrough. Such a valve may be of a type in which the body is retreivable from within the tubing string, or in which the body is connected as part of the tubing string - i.e., tubing mounted. Ordinarily, the closure member is a flapper pivotally mounted in the bore of the body and adapted to be moved to open position by a flow tube with which the piston means is engagable for reciprocation within the bore. Thus, the supply of hydraulic fluid lowers the flow tube to force the flapper to open position, and the spring means acts on the piston means to raise the flow tube and thus permit the flapper to close upon the exhaust of hydraulic fluid.

U.S. Pat. No. 3,799,258 shows a typical tubing mounted valve of this type wherein the piston means comprises an annular piston about the flow tube disposed within an annular pressure chamber between the flow tube and valve body and urged to its position permitting the flapper to close by means of a coil spring compressed between the valve body and the flow tube. However, when valves of this type are installed at great depths, it is difficult for a coil spring of acceptable size and strength to overcome the hydrostatic head of the hydraulic fluid in the control line leading to the pressure chamber, and thus raise the flow tube to permit the flapper to close.

In accordance with U.S. Pat. No. 4,161,219, it was proposed to solve this problem by the use of piston means which, as compared with the annular piston of U.S. Pat. No. 3,799,358, is disposed within a cylinder formed in the valve body to one side of the flow tube and engagable at its lower end with the flow tube to move it to its lower position in response to supply of the hydraulic fluid to the cylinder. Thus, it was thought possible to reduce the cross-sectional area of the piston means, and thus the downward force on the flow tube due to the hydrostatic pressure of the control fluid, sufficiently to enable the flow tube to be raised, and thus permit the flapper to close upon exhaust of the control fluid, with a smaller coil spring.

As there is a significant area change between concentric or annular pistons and side pistons at intermediate depths, the designer is forced with the decision of using multiple pistons or weaker springs. Multiple pistons are expensive and weaker springs are less safe. A superior design would be one that had a stronger spring with sufficient force to lift a less expensive concentric piston even at great depths.

It is therefore the primary object of this invention to provide a valve of this type having annular spring means of such construction as to provide sufficient force to raise the flow tube to flapper closing position, despite installation at great depth in the well, while at the same time occupying substantially no more space within the valve body than would be required to accommodate conventional coil springs.

A more particular object is to provide such a valve in which the spring means is relatively inexpensive to manufacture, and, if desired, of a configuration which is readily available from commercially available sources.

These and other objects are accomplished, in accordance with the illustrated embodiments of the invention, by a subsurface safety valve of the general type above described wherein the piston means as well as the spring means for urging it upwardly to a position permitting the flapper to close are of annular configuration, but wherein the spring means is of a curved beam type which requires no more space than would be required by a conventional coil spring and yet which provides sufficient force to urge the piston upwardly to permit the flapper to close despite disposal of the valve in the tubing string at great depths. More particularly, the curved beam type spring means may be of commercially available construction, usable in other environments, comprising a substantially flat, helical wire in which arcuate beams are formed between undulations on one flat side of each turn which engage oppositely disposed undulations on oppositely facing sides of adjacent turns. Alternatively, the curved beam type spring may comprise tubular body means in which arcuate beam are formed between vertically spaced rows of horizontally extending slots which are staggered with respect to those of adjacent rows. In either case, the spring is made up of vertically spaced rows of arcuate beams each of which is supported at its opposite ends intermediate the supported ends of beams in adjacent vertical rows. Thus, as compared with conventional coil springs, which are loaded torsionally, the beams in adjacent rows are bendable toward one another as the spring means is axially compressed.

In the drawings, wherein like reference characters are used throughout to designate like parts:

FIG. 2 is a perspective view of a portion of the embodiment of the curved beam type spring used in the valve of FIGS. 1A and 1B;

FIG. 3 is a side view of the spring portion of FIG. 2;

FIG. 4 is a view of the spring portion shown in FIG. 3, but upon axial loading thereof; .

FIG. 5 is a side view of a portion of an alternative embodiment of the curved beam type spring; and FIG. 6 is a top plan view of the embodiment of the spring shown in FIG. 5.

Figure 1A:
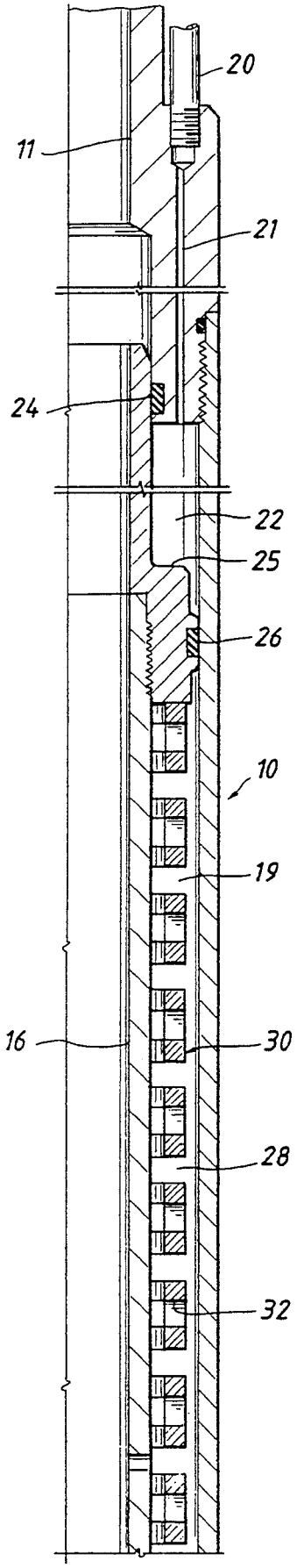
FIGS. 1A and 1B are half vertical sectional views of upper and lower portions of a subsurface tubing safety valve constructed in accordance with one embodiment of the invention, and showing the flow tube thereof moved to its lower position to swing the flapper to its open position.
Figure 1B:
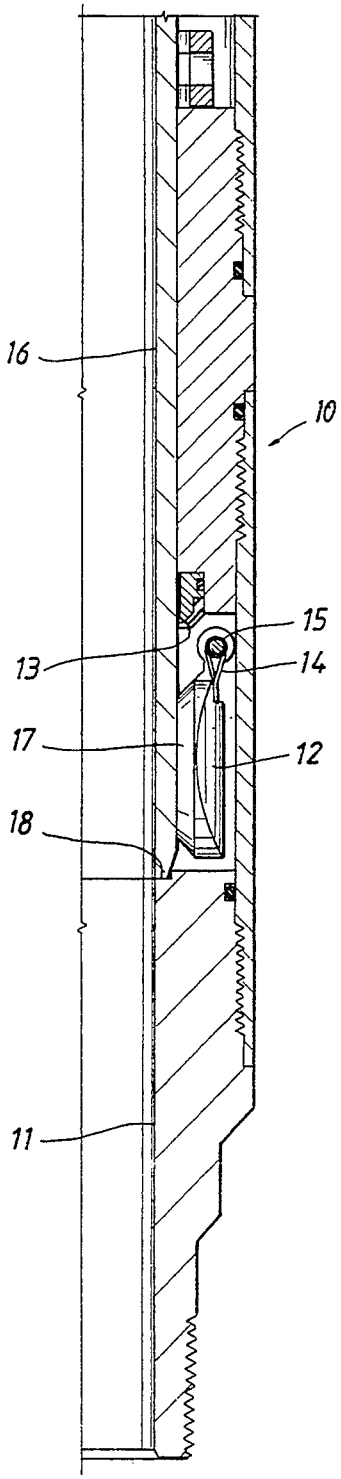

With reference now to the details of the above described drawings, the subsurface safety valve shown in FIGS. 1A and 1B comprises a body 10 connectible at its upper and lower ends as part of a tubing string suspended within a well bore and having a bore 11 therein forming a continuation of the tubing string when so connected. As well known in the art, the valve 10 is normally installed in the tubing at a substantial depth beneath the surface, thus giving rise to the problems above discussed in the operation of valves of this type of conventional construction. A flapper type closure member 12 is pivotally mounted within a lower portion of the body for swinging between the position shown in FIG. 1 in which it opens the bore through the body, and an alternate position (not shown) in which it engages a downwardly facing seat 13 about the bore of the body to close same.

The flapper is normally urged to its closed position by means of a torsion spring 14 surrounding a pivot pin 15 by which the flapper is connected to the tubular body 10, and is adapted to be moved to its open position by means of a flow tube 16 vertically reciprocal within the bore of the body. Thus, as the flow tube is lowered to the position illustrated in the drawings, in a manner to be described to follow, its lower end engages the upper side of the normally closed flapper to swing it to its open position. On the other hand, when the flow tube is raised to its upper position (not shown), its lower end is spaced above the upper side of the closed flapper to permit the flapper to fully close.

When in its open position, the flapper occupies a space 17 between the lower end of the flow tube and an enlarged inner diameter portion of the tubular body beneath the seat 13. Also, the lower end of the flow tube has engaged a shoulder 18 on the body at the lower end of the space to prevent further downward movement of the flow tube. When the flow tube moves upwardly to permit the flapper to close, a shoulder thereabout engages shoulder 20B on the body to limit further movement.

The upper end of the tubular body and the flow tube form an annular space 19 between them. A tube 20 (FIG. 1A) is connected at its lower end to a port 21 in the tubular body leading to the upper end of space 19. This tube 20 extends upwardly to the surface for connection with a suitable source of hydraulic fluid. As shown in FIG. 1A, the flow tube 16 is sealably slidable within an intermediate portion of the tubular body 10 to form an annular pressure chamber 22 in the upper end of annular space 19 and thus with the lower end of the port 21. More particularly, the upper end of the flow tube is sealably slidable within a seal ring 24 carried about the inner diameter of the tubular body, and a piston 24 about the flow tube carries a seal ring 25 for sealably sliding within the enlarged inner diameter of the tubular body at the lower end of the annular pressure chamber 22. Hence, the introduction of hydraulic fluid into the chamber 22 through the tube 20 will urge the flow tube downwardly toward its lower position so as to open the flapper.

The portion of the tubing safety valve above described is of more or less conventional construction, and corresponds in many respects to the valve shown in the aforementioned U.S. Pat. No. 3,799,258. As well known in the art, and as described in that patent, upon exhaust of hydraulic fluid from the pressure chamber 22, for whatever reason, the flow tube is urged upwardly by the spring means to be described in order to permit the flapper to close.

The embodiment of the spring means shown in FIGS. 1A and 1B, as well as in FIGS. 2 to 4, and indicated in its entirety by reference character 30, comprises a tubular body 31 of a length as to extend from one end to the other of a spring chamber 28 defined between the lower side of the piston 24 and the upper end of a reduced diameter portion of the tubular body above the seat 13. Preferably, when so disposed, the spring is expanded yet still provides sufficient force to lift the piston 23 against the hydrostatic force of the hydraulic fluid even in a deep set valve.

As shown, vertically spaced rows of horizontally extending slots 32 are formed through the tubular body, as by saw cuts, with the slots in each row being staggered with respect to those of adjacent rows. Thus, the spring is made up of a series of vertically spaced arcuate beams 33 connected to and supported at their opposite ends by vertically extending struts 34 generally equidistant the support of adjacent beams in adjacent rows of beams. Consequently, and as illustrated in FIG. 4, axial loading of the spring due to lowering of piston under the urging of hydraulic fluid in chamber 22 will cause all but the endmost beams to bend intermediate the struts at their opposite ends. Thus, as previously described, and as compared with conventional coil springs which are loaded in a torsional sense, the axial loading is resisted primarily by bending of the arcuate beams in adjacent vertical rows toward one another.

Although the spring means 30 is shown to be made of a single tubular body in which the slots are formed to define the beams, it is obvious that the tubular body may be made up of separate vertically stacked, slotted body sections.

The embodiment of the curved beam type spring shown in FIGS. 5 and 6, and designated in its entirety by reference character 40, comprises a helical coil 41 of undulating, substantially flat wire with the peaks of the flat sides of each turn of the coil engaging with the valleys of the flat sides of adjacent turns. Thus, for example, one intermediate turn 42 of the section of the spring shown in FIG. 5 has the valleys of its lower flat side supported at 43 by the peaks of the upper flat sides of the next lower turn 44, and the peaks of its flat upper sides supporting the valleys of the lower flat side of the next upper turn 45. This then forms, similarly to the spring 30, rows of vertically spaced, arcuate beams which are supported at their opposite ends intermediate the support of the opposite ends of the beams of adjacent rows. Consequently, when the spring is loaded in an axial sense, the beams of adjacent vertical rows will bend toward one another so as to permit the overall length of the spring to be compressed as it is axially loaded by lowering of the piston of the flow tube in response to hydraulic fluid.

A curved beam type spring of the latter type is manufactured and sold by the Smalley Steel Ring Company of Wheeling, Ill. To my knowledge, however, such springs have not been used, or proposed for use, with a valve of the type described. Springs of this type in this size, load, and rate are beyond the normal commercial product availability.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A subsurface safety valve, comprising a tubular body disposable in a well string, a closure member mounted within the body for movement between positions opening and closing the bore therethrough, means yieldably urging the closure member to closed position, means including a flow tube vertically reciprocable within the body and having an annular piston sealably slidable with respect to the body to form an annular pressure chamber on one side of the piston, and means by which hydraulic fluid from a remote source may be introduced into the pressure chamber in order to lower said piston to cause the flow tube to open the closure member; and curved beam type spring means compressed between the body and piston to raise the flow tube and thereby permit the closure member to be closed upon the exhaust of hydraulic fluid.

2. A valve of the character defined in claim 1, wherein the curved beam type spring means comprises vertically spaced rows of arcuate beams each of which is supported at its opposite ends intermediate the supported ends of beams in adjacent vertical rows whereby the beams in adjacent rows are bendable toward one another as the spring means is axially compressed.

3. A valve of the character defined in claim 2, wherein said curved beam type spring means comprises tubular body means in which the beams are formed between vertically spaced rows of horizontally extending slots which are staggered with respect to those of adjacent rows.

4. A valve of the character defined in claim 2, wherein said curved beam type spring means comprises a substantially flat helical wire in which the beams are formed between undulations on one flat side of each turn which engage oppositely disposed undulations on oppositely facing sides of adjacent turns.

* * * * *